United States Patent [19]

Krenzer et al.

[11] 4,163,529

[45] Aug. 7, 1979

[54] NON-ROTATING AXIALLY-PAYING-OUT SKI-ROPE BOBBIN

[76] Inventors: Orville Krenzer, R.R. #3, Springfield, Ill. 62707; William E. Midden, 2036 S. Spring, Springfield, Ill. 62704; Charles F. Schmid, 3408 S. Fourth, Springfield, Ill. 62703

[21] Appl. No.: 833,366

[22] Filed: Sep. 14, 1977

[51] Int. Cl.[2] ..... B65H 75/40; B63B 21/56

[52] U.S. Cl. ..... 242/85.1; 114/254; 242/86.5 A

[58] Field of Search ..... 242/85.1, 86.5 A, 128, 242/129, 54 R, 55; 114/254, 253

[56] References Cited

U.S. PATENT DOCUMENTS

| | | | |
|---|---|---|---|
| 1,826,491 | 10/1931 | Allan | 242/128 |
| 2,893,045 | 7/1959 | Dalbec | 242/85.1 X |
| 3,113,547 | 10/1963 | Stewart | 242/85.1 X |

*Primary Examiner*—George F. Mautz
*Attorney, Agent, or Firm*—Ralph F. Staubly

[57] ABSTRACT

A non-rotating axially-paying-out ski-rope bobbin comprises a molded-plastic body shaped to define a vertical-axis circumferentially-open annular space for receiving a ski-rope manually wound therein. A plurality of suction cups are fixed to the under face of the body for quickly and easily detachably fastening the bobbin to the rear deck of a motor boat. A bail-shaped element is swingable from a storage position in a plane close to and parallel to the plane of the suction cups, to an upright use position in which its crest overlies the bobbin adjacent its axis. A ski-rope guide is fixed to, or formed in, the crest of the bail-shaped element to change the vertical-conical over-edge rope-paying-out to a horizontal rearward paying-out. The guide is vertically open so that the rope, whose boat end is to be tied to the boat transom, will pull free from the bobbin when fully unwound therefrom.

9 Claims, 9 Drawing Figures

Fig. 1
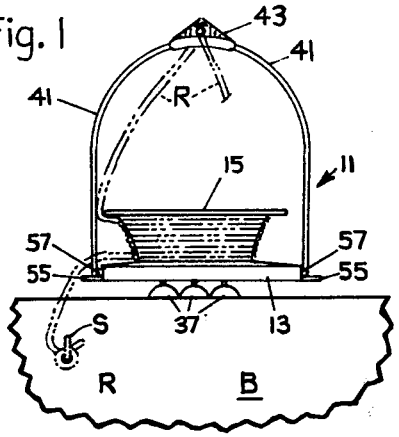
Fig. 2
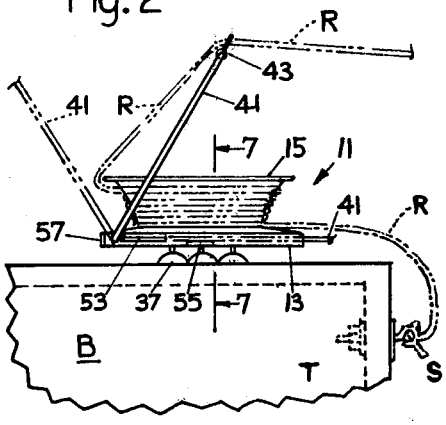
Fig. 6
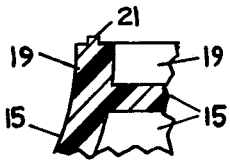
Fig. 7
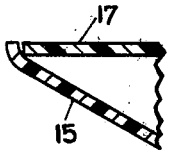
Fig. 3
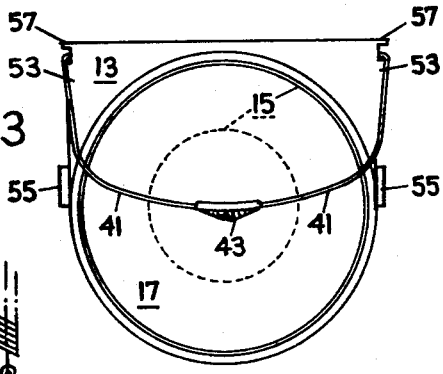
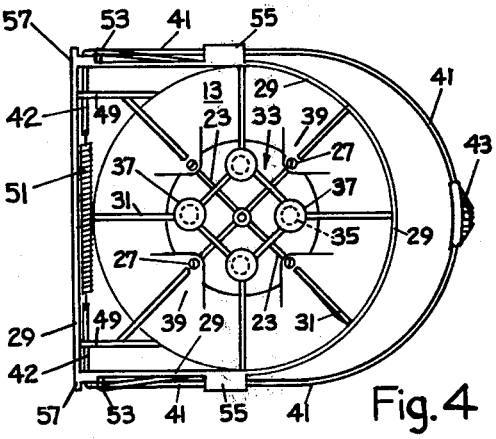
Fig. 4
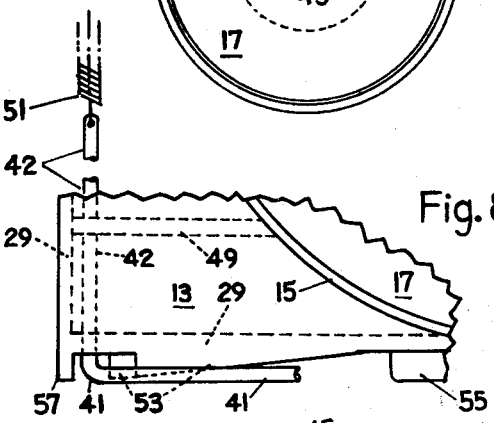
Fig. 8
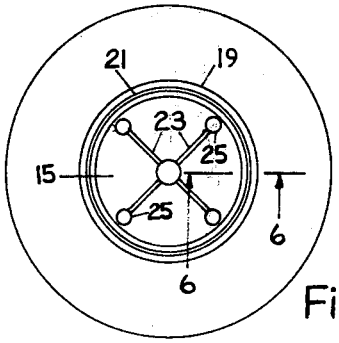
Fig. 5
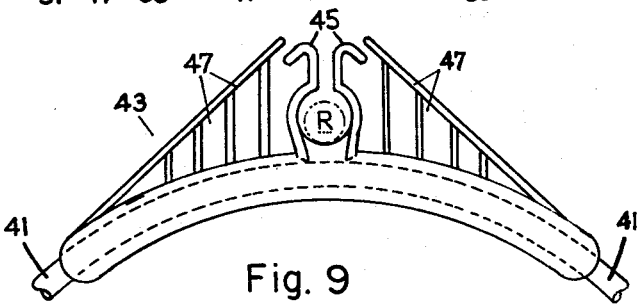
Fig. 9

NON-ROTATING AXIALLY-PAYING-OUT SKI-ROPE BOBBIN

BACKGROUND AND OBJECTS OF THE INVENTION

A known type of non-rotating ski-rope bobbin provides for vertical-axis manual winding-up of the rope, and for over-edge rope paying-out by hinging the bobbin to a deck-attached support so that it can be swung into a rearwardly facing horizontal-axis position. But it has been found that with such a construction the paying-out is unreliable unless the angle between the boat's course and the rope being paid-out is held within a relatively narrow range.

It is accordingly the principal object of this invention to provide a non-rotating ski-rope bobbin in which the rope paying-out is reliable over a wide-angle range. It is a further object to provide such a bobbin in which its axis can conveniently remain vertical for both winding-up and paying-out the ski-rope. Other objects and advantages will become apparent as the following detailed description proceeds.

BRIEF DESCRIPTION OF THE DRAWINGS

FIG. 1 is an elevational view of a preferred embodiment of the invention as seen from behind a towing boat.

FIG. 2 is a side elevational view of the bobbin of FIG. 1 viewed from the left side of FIG. 1.

FIG. 3 is a somewhat enlarged plan view of the showing of FIG. 1.

FIG. 4 is a somewhat enlarged plan view from below of the showing of FIG. 2 but with the bail-like element in storage position.

FIG. 5 is an enlarged plan view from below of the upper (dish-shaped) member of the bobbin body.

FIG. 6 is a further enlarged fragmentary elevational view in section taken on the line 6—6 of FIG. 5.

FIG. 7 is an enlarged fragmentary elevational view in section taken on the line 7—7 of FIG. 2.

FIG. 8 is an enlarged fragmentary plan view of the near left portion of FIG. 2.

FIG. 9 is an enlarged elevational view of the rope-guide element of FIG. 1.

With reference now to the drawings, the numeral 11 generally designates the bobbin assemblage, which basically comprises a base or platform member 13 and a dish-shaped upper member 15, both being of molded stiff plastic material. The dish of the upper member 15 may be left open, or it may be closed by an edge-sealed disc 17 (FIG. 7) to provide a flotation chamber. The bottom surface of the member 15 has an annular rib 19 (FIGS. 5 and 6) for seating against the base or platform member 13. The rib has an annular bead 21 formed thereon for seating in a positioning mating groove (not shown) in the upper surface of the platform member 13. The member 15 also has rigidifying ribs 23 and molded-on axially bored bosses 25 to receive self-tapping screws 27 (FIG. 4) by which the members 13 and 15 are joined.

The base or platform member 13 has a downturned marginal flange 29 and radial ribs 31 (FIG. 4) for rigidifying the member. Base 13 also has molded to certain of its ribs 31 a box-like structure 33 having enlarged boss-forming corner portions 35. The portions 35 are vertically bored to receive threaded sleeves (not shown) or to be self-tapped by the threaded shafts of conventional suction cups 37 screwed therein (or into said sleeves if used). Areas 39 are molded-on thickened-for-strength portions to receive the members-assembling screws 27.

The ski-rope-paying-out guide comprises a stiff-wire (or rod) bail-shaped element 41 and a formed-therein (not shown) or a molded-on plastic head 43 (FIG. 9). The head 43 has an upwardly open constricted-outlet rope-guide formed by its somewhat flexible integral fingers 45. The inclined side portions 47 are to protect the fingers 45 from breakage by acting as stops to prevent excessive lateral bending thereof by the ski rope or by acting as guards against externally applied blows. The inclined surface also serves to guide the end portion of the rope up to the outlet gap of the rope guide 43 for release from the guide as described hereinafter.

The lower (or rear) portions 42 of the rod element 41 are bent at right angles to extend inwardly through bearing apertures in the base flange 29 and in ribs 49, and their ends are apertured to receive the looped ends of a tensioned coil spring 51 which prevents the rod element from camming too easily over the molded-on stops 53. Molded-on stops 55 arrest downward swinging of the rod element 41 in its storage or rope-winding-in position, while stops 57 prevent excessive swinging of element 41 behind its upright use position.

In use the bobbin is fixed by its suction cups to the reardeck or other surface of a boat B to which a ski rope R has been tied in a screw-eye S. With the guide member 41–43 in its down or storage position, the rope R from the screw-eye is passed over the guide member and is manually wound onto the bobbin. For paying-out, the guide member is raised to its FIG. 2 full-line position and the rope is allowed to pay-out upwardly over and around the top edge of the bobbin and through the guide 43. When the rope is fully unwound, its end portion rides up over the bailshaped element 41 and over the inclined surface of portion 47 of the rope guide 43 to its release gap to be pulled therethrough and free from the bobbin. If the rope should kink or otherwise not release freely, the resultant pull will swing the guide member and its support downwardly to insure release of the rope.

The invention having been described, what is claimed as being patentable is:

1. A non-rotating axially-paying-out ski-rope bobbin comprising: a body shaped to define a circumferentially open annular cavity for receiving rope wound therein, means for attaching said body to a relatively flat surface with the axis of said cavity substantially perpendicular to said surface, guide-carrying means, means mounting said guide-carrying means for movement from an out-of-way rope-winding-up position generally below the cavity to a position generally above the cavity for rope paying-out, and a rope-embracing guide fixed to said guide-carrying means so as to be close to the axis of said cavity when said guide-carrying means is in its rope-paying-out position, whereby axially oriented paying-out of rope over and around the nearer-guide edge of said cavity is converted to wide-angle rearward paying-out, said rope-embracing guide being constructed and arranged to retain said rope therein while freely moving but to release said rope therefrom in response to an increased pull resulting when the rope is fully unwound and has its near end fastened to boat structure.

2. Structure according to claim 1, said attaching means being at least one suction cup.

3. Structure according to claim 1, said guide-carrying means being a bail-shaped element having ends pivotally connected to said body for swinging between its above-the-bobbin use position and its out-of-way generally below-cavity position for rope-winding-up, storage and/or carrying, said body having element-engaging first stop means limiting movement of said element beyond extreme positions and second stop means of cam shape for normally arresting swinging of said element in its rope-guiding position but permitting said element to cam past said second stop means for movement toward said out-of-way position.

4. Structure according to claim 3, said rope-embracing guide being shaped to serve also as a handle for carrying said bobbin.

5. Structure according to claim 1, said guide being a plastic member having upstanding integral fingers defining an upwardly open top-constricted guide passage to receive said rope, said fingers being flexible so as to separate for releasing said rope when unwound, and said plastic member having portions serving as flexible-finger-protecting means and as inclined-surface-defining means for guiding an end-anchored portion of rope upwardly toward said guide-passage for disengagement therefrom.

6. Structure according to claim 3 and additionally comprising a coil spring tensionedly connected between the inturned pivoted ends of said bail-shaped element to increase the force needed to cam said element past said second stop means.

7. Structure according to claim 1 and including flotation means.

8. Structure according to claim 7, said flotation means comprising an air chamber formed by an upwardly facing dished cavity in said body and a cavity-sealing lamina covering said cavity.

9. Structure according to claim 1, said annular cavity decreasing in diameter away from its nearer-guide edge to lessen friction that otherwise could result from sharp-angle bending of first-wound rope portions in paying-out over the edge of the annular cavity.

* * * * *